United States Patent [19]

Logan

[11] 4,354,699

[45] Oct. 19, 1982

[54] RETROFITTED POINT-OF-EGRESS CONTROL DEVICE FOR SECURING EMERGENCY EXIT DOORS SAFELY

[75] Inventor: Emanuel L. Logan, Arlington, Va.

[73] Assignee: Reliable Security Systems, Inc., Cockeysville, Md.

[21] Appl. No.: 148,383

[22] Filed: May 9, 1980

[51] Int. Cl.[3] ..... E05C 15/02

[52] U.S. Cl. ..... 292/201

[58] Field of Search ..... 292/45, 52, 78, 79, 292/92, 93, 192, 201, 209, DIG. 65; 70/92, 267, 268, 270; 340/542

[56] References Cited

U.S. PATENT DOCUMENTS

| | | | |
|---|---|---|---|
| 2,588,010 | 3/1952 | Kennon | 16/55 |
| 2,733,918 | 2/1956 | Fischer | 292/144 X |
| 2,851,296 | 9/1958 | Guyaz | 292/78 |
| 2,881,020 | 4/1959 | Kok | 292/78 |
| 3,309,125 | 3/1967 | Neveling | 292/78 |
| 3,383,130 | 5/1968 | De Avila | 292/92 |
| 3,435,643 | 4/1969 | Pollak et al. | 70/92 |
| 3,583,740 | 6/1971 | Armstrong | 292/198 |
| 3,677,043 | 7/1972 | Cox | 70/92 |
| 3,970,339 | 7/1976 | Haselton et al. | 292/227 |
| 4,006,471 | 2/1977 | Pappas | 340/274 R |

FOREIGN PATENT DOCUMENTS

| | | |
|---|---|---|
| 1130325 | 5/1962 | Fed. Rep. of Germany . |
| 7403756 | 2/1974 | Fed. Rep. of Germany . |
| 304335 | 1/1955 | Switzerland . |

*Primary Examiner*—Richard E. Moore
*Attorney, Agent, or Firm*—John R. Moses

[57] ABSTRACT

In order to secure an emergency exit door against unauthorized opening from the inside, a retrofit delay mechanism is attached to the door frame. The delay mechanism includes a retractable bolt which projects behind a strike mounted on the door. A piston is attached to the bolt and a hydraulic circuit is connected to the piston. The hydraulic circuit includes a throttle and a normally open valve. The normally open valve is held closed by a solenoid. Upon attempting to open the door, fluid in the hydraulic circuit is throttled slowing down retraction of the bolt and delaying opening of the door. The solenoid which releases the normally open valve is connected to a timing circuit which de-energizes the solenoid after a predetermined time interval thus providing a redundant delay arrangement. Smoke detectors, fire pull-boxes and a remote reset switch are also connected to the solenoid via a dropout relay. Upon the occurrence of an emergency situation, the dropout relay de-energizes the solenoid allowing fluid to flow freely in the hydraulic circuit so that the door opens immediately. The retrofit delay mechanism operates in conjunction with existing panic hardware.

11 Claims, 12 Drawing Figures

RETROFITTED POINT-OF-EGRESS CONTROL DEVICE FOR SECURING EMERGENCY EXIT DOORS SAFELY

RELATED U.S. PATENT APPLICATIONS

Ser. No. 929,968—Filed Aug. 1, 1978, U.S. Pat. No. 4,324,425
Ser. No. 22,110—Filed Mar. 20, 1979, U.S. Pat. No. 4,351,552
Ser. No. 051,724—Filed Sept. 25, 1979, U.S. Pat. No. 4,257,631
Ser. No. 065,491—Filed Aug. 10, 1979, abandoned
Ser. No. 125,995—Filed Feb. 29, 1980, U.S. Pat. No. 4,328,985

BACKGROUND OF THE INVENTION

1. Field of the Invention

This invention relates to apparatus for delaying opening of doors. More particularly, this invention relates to apparatus for delaying opening of doors such as emergency exit doors or fire doors while providing a signal indicating that an attempt is being made to open the doors.

2. General Considerations and Prior Art

The above-identified patent applications each relate to the concept of delaying opening of a door while sounding an alarm or providing another signal indicating that an attempt to open the door is being made. As is set forth in each of the above-cited patent applications this concept is useful in solving the conflict between fire officials, fire regulations and security officials. Generally, fire codes specify that certain doors cannot be locked with respect to the inside of a building when the building is occupied so that occupants can escape if a fire or other emergency situation arises. However, the chronic crime problem has caused people concerned with security to lock these doors with padlocks and chains. By providing doors with a delay which under ordinary circumstances secures the door for a period of time and which under emergency circumstances releases the door immediately, a satisfactory solution to the fire-security conflict is provided. The control of the emergency exit door is at the "point of egress" so that the person desiring egress may obtain it if he or she is willing to wait for it while a rather embarrassing alarm rings over his or her head, notifying others in the general vicinity of the door that the person wants out. If necessary or desirable, an additional alarm can be set off at a central control station alerting security personnel that egress is being attempted. If there is a true emergency, and the immediate emergency release fails, the door can still be opened after the time interval of the delay has expired.

Under certain circumstances it may be desirable to divorce the unlatching structure of a door such as an emergency exit door from the delay structure so that the delay structure can be retrofitted on existing doors which already have their own hardware. Such an approach is disclosed in co-pending patent application Ser. No. 051,724—Magnetic Emergency Exit Door Lock System and co-pending patent application Ser. No. 089,398—Door Check Type Delay. Both of these approaches have disadvantages which may forestall their use. With the magnetic arrangement, there is a problem of residual magnetism which must be overcome in order to open a door even after the magnet is de-energized. In the door closure type of delay device, the door is never completely free of the door closure jamb which can interfere with ordinary operation of the door wherein the door operates in a non-delay mode. Accordingly, there is a need for a delay apparatus which can be easily applied to emergency exit doors as a retrofit for existing installations or as an accessory for planned installations which use conventional latching and locking hardware.

SUMMARY OF THE INVENTION

It is a feature of the instant invention to provide a new and improved securing system for emergency exit doors wherein a delay apparatus is utilized which is separate from the normal door latch and thus can be retrofitted.

In view of this feature the instant invention contemplates apparatus for securing an emergency exit door which apparatus includes a delay having a closure operated bolt which extends between the door and door frame wherein retraction of the bolt is retarded or delayed so as to delay opening of the door. While the opening is being delayed an indicating device signals that an attempt is being made to open the door.

The instant invention further contemplates utilizing the delay apparatus on a door equipped with a latch and panic bar without providing any mechanical or electrical connection between the panic bar or latch and the delay apparatus other than perhaps the door panel itself.

Moreover, the instant invention contemplates means for deactivating the delay either manually, preferably at a remote station, or automatically upon the occurrence of an emergency condition.

DESCRIPTION OF THE PREFERRED EMBODIMENT

Figure 1:
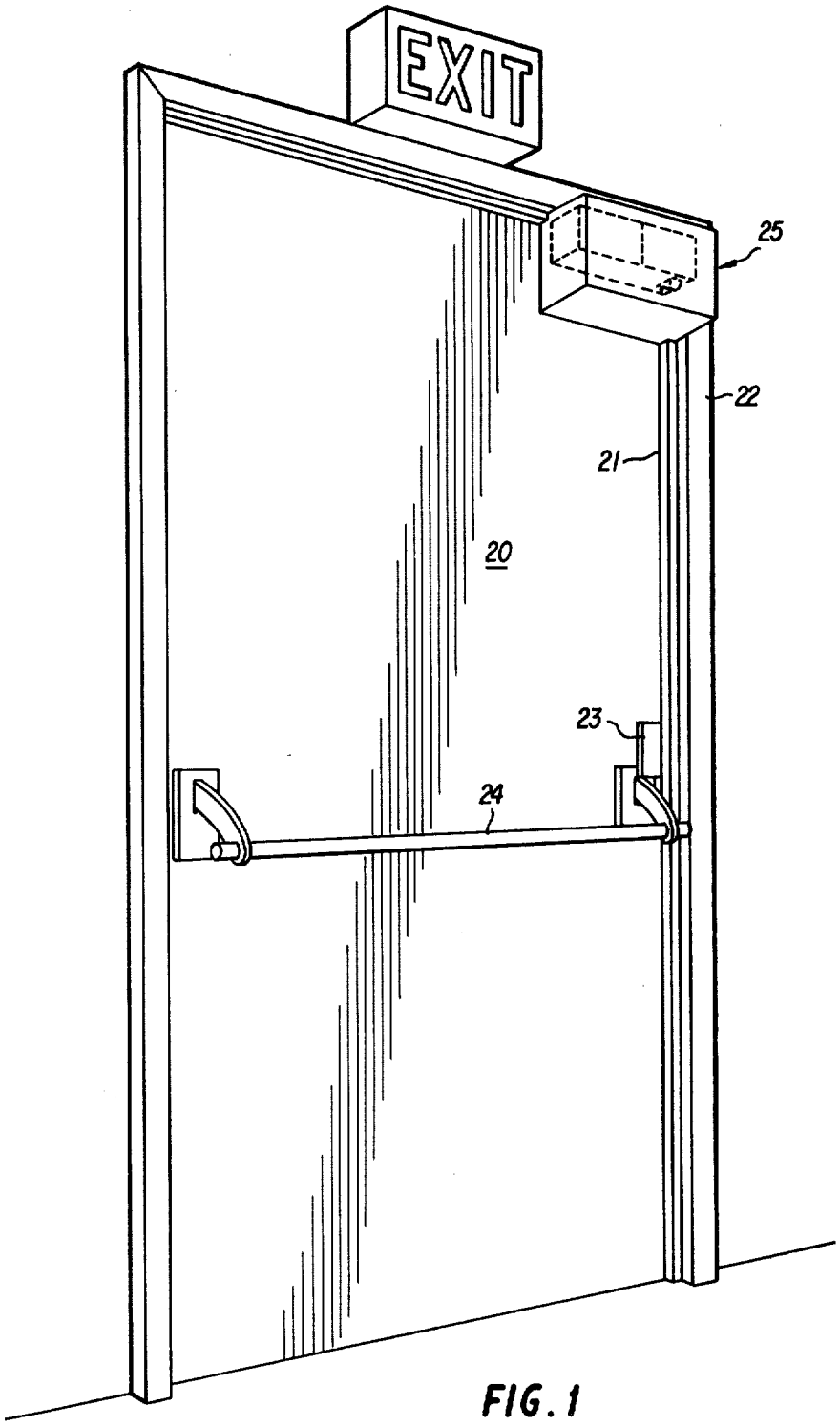
FIG. 1 is a perspective view of an emergency exit door viewed from the inside with a delay apparatus in accordance with the instant invention mounted on the door jam for retarding opening of the door.

Referring now to FIG. 1 there is shown an emergency exit door 20 which is hinged to close against door jam 21 of door frame 22. The door 20 is equipped with a conventional panic latch 23 which is unlatched by a panic bar 24. A delay apparatus, designated generally by numeral 25, is secured to the door frame 22 in an upper corner thereof adjacent the free edge of the door 20. When the door 20 is opened, it pivots about its hinged edge so as to move away from the delay apparatus 25. While the delay apparatus 25 is shown mounted in the corner of the door frame 22, it could be mounted at any convenient location such as near the middle of the top frame member.

Figure 2:
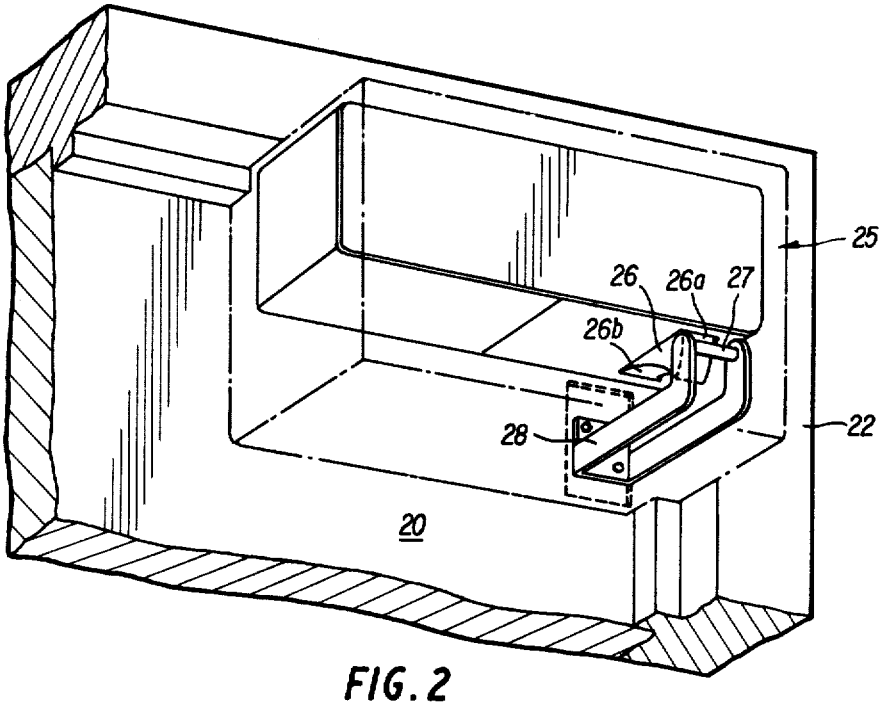
FIG. 2 is an enlarged perspective view of the delay apparatus in accordance with FIG. 1 showing the door secured.

Referring now to FIG. 2, the delay apparatus 25 has a bolt 26 thereon which when projected engages a strike 27 which is mounted on a U-shaped bracket 28 that is secured to the door 20. In FIG. 2, the door 20 is closed so that a first cam surface **26*a* on the bolt 26 engages the strike 27**.

Figure 3:
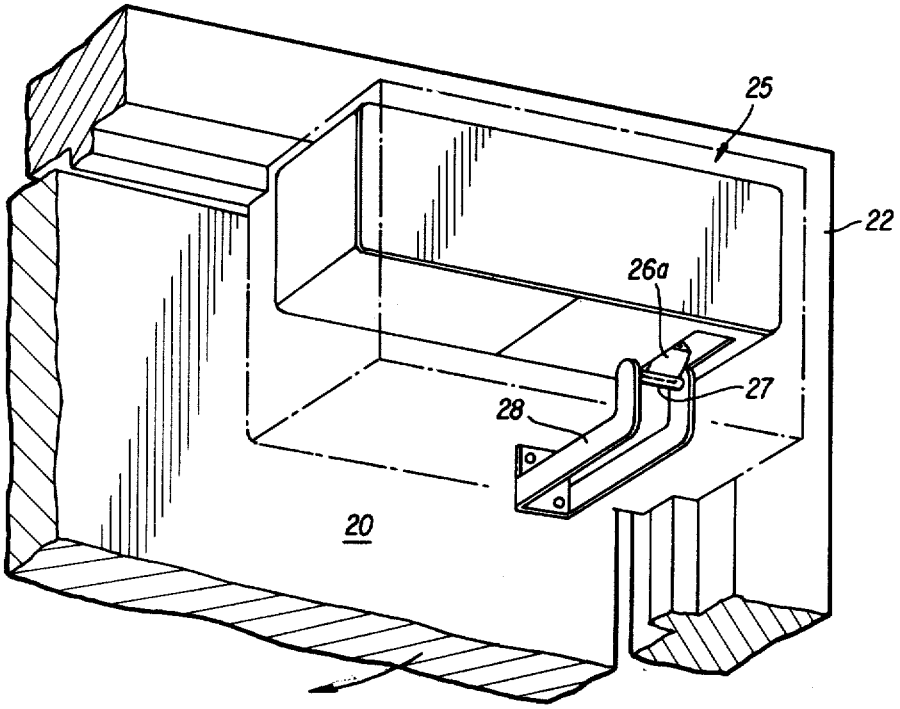
FIG. 3 is a view similar to FIG. 2 but showing the door opening against the delay apparatus.
Figure 4:
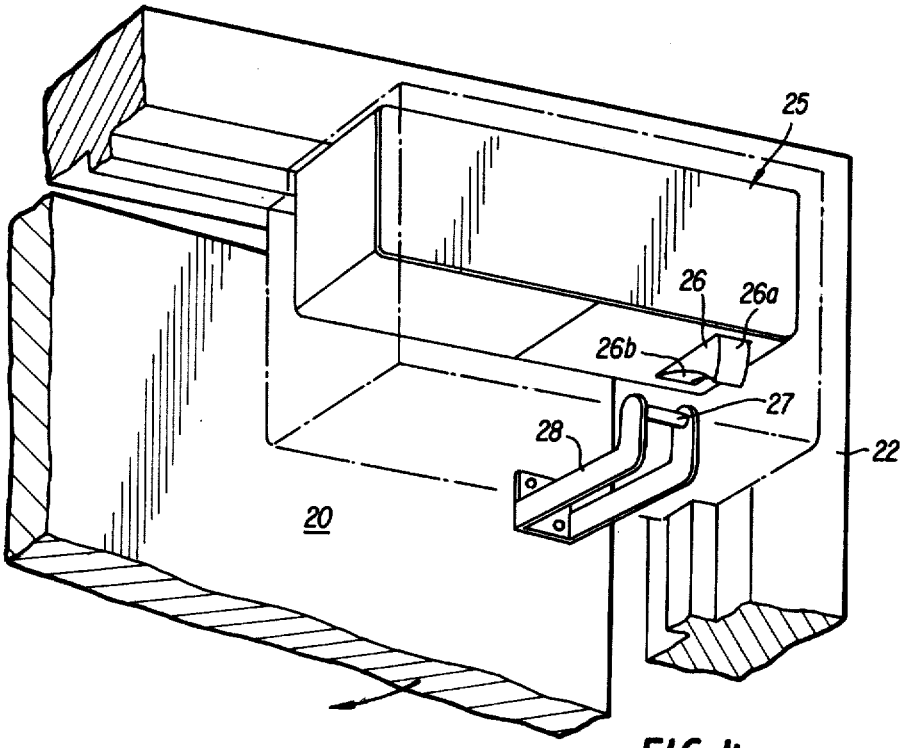
FIG. 4 is a view similar to FIG. 2 showing the door in the open position.
Figure 5:
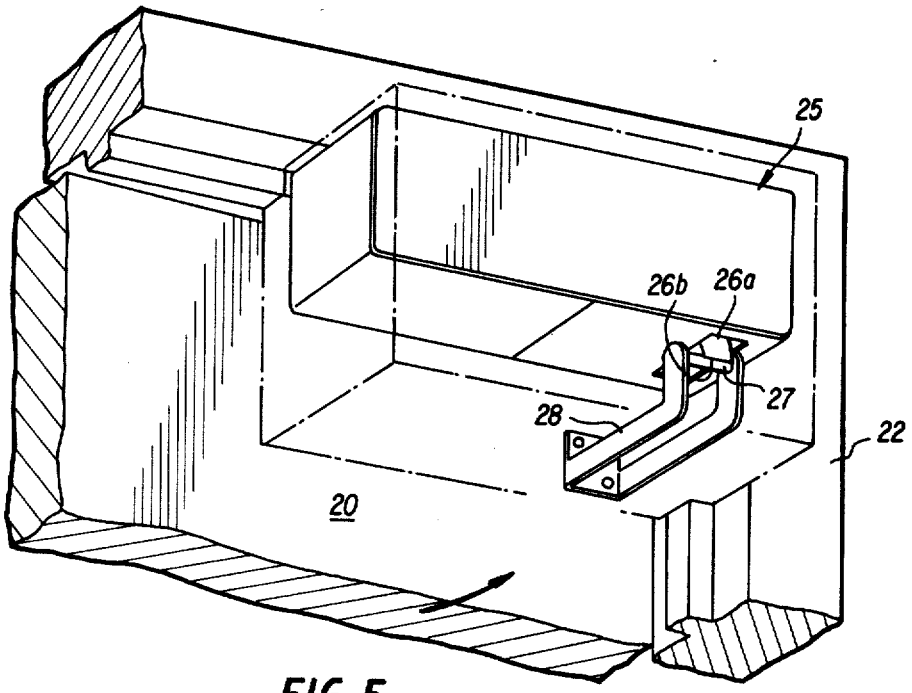
FIG. 5 is a view similar to FIG. 2 showing the door closing so as to reset the delay.

After the door 20 is unlatched by pressing on panic bar 24 (FIG. 1) to withdraw the latch bolt of latch 23 (FIG. 1), pressure against the door 20 or the panic bar 24 causes the bolt 26 to retract by moving into the delay apparatus 25 as is seen in FIG. 3. Once the bolt 26 has retracted sufficiently far for the strike 27 to clear bolt, the door 20 can be opened, as is seen in FIG. 4. Upon closing the door, a second cam surface **26*b* on the bolt 26 is engaged by strike 27 to cam the bolt back into the delay apparatus 25 so that the strike can move past the bolt. When the strike 27 moves past the bolt, the bolt 26 again projects as is shown in FIG. 2** so as to secure the door.

As will be further explained hereinafter, the bolt can be controlled so as to allow the door 20 to open immediately, to delay opening of the door or even to prevent opening of the door, depending on which condition is selected. A primary purpose of the invention is, however, to delay opening of the door. As will be further set forth hereinafter, an alarm may be provided at the door 20 to sound when an attempt is made to open the door so as to discourage unauthorized opening of the door. Moreover, the delay apparatus may be bypassed or deactivated by the occurrence of an emergency condition.

The particular configuration of the delay mechanism 25 is similar to that disclosed in U.S. patent application Ser. No. 22,100, filed Mar. 20, 1979, and assigned to the assignee of the instant invention. In Ser. No. 22,100 the bolt 26 is held projected by a toggle linkage 30 which is "broken" or pushed over center by a pushbar in order to undog the bolt 26. In the instant invention there is no need to dog the bolt 26 in the projected position, accordingly the linkage 30 is held in the over center position by a shim 29 (see FIGS. 6–10) which is added to the mechanism 25 if the mechanism is to be used simply as a delay in the retrofit configuration of the instant application. Accordingly, the same essential delay mechanism 25 can be used for either the latching arrangement disclosed in Ser. No. 22,110 or the delay arrangement of the instant application.

Figures 6, 6A:
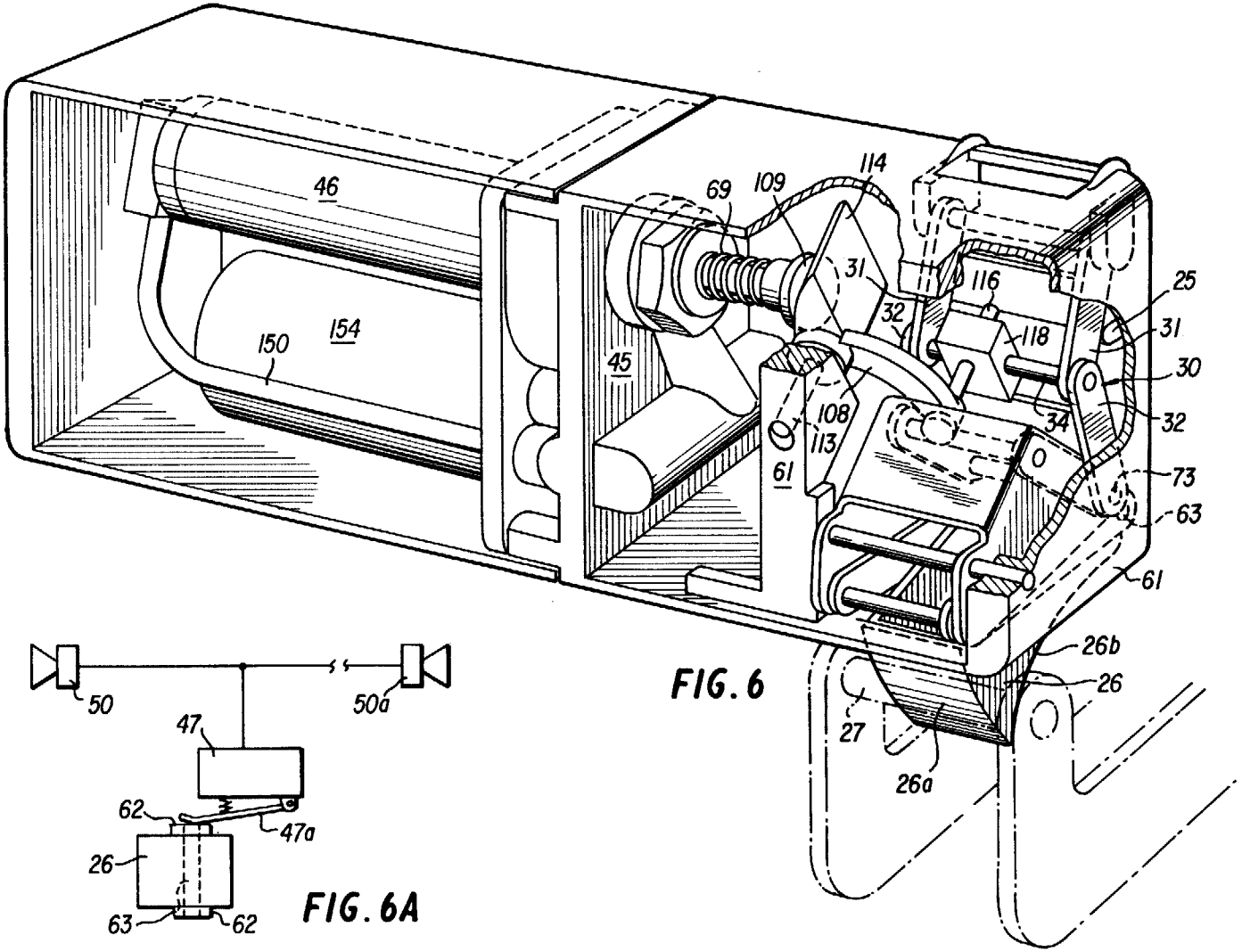
FIG. 6 is a perspective view showing the mechanism for delaying retraction of the latch bolt, and FIG. *6a* is a view of the bolt-operated alarm system.

Generally, the delay is effected by delaying circulation of fluid in a hydraulic circuit 45 which is perhaps best understood upon considering FIG. 6 in conjunction with FIG. 13. In operation, when pressure is applied by the strike 27 against the first camming surface **26*a* of bolt 26, that pressure is transmitted to the hydraulic delay circuit 45 which delays retraction of the bolt by coupling the retraction to a throttle which limits the speed at which fluid can move from one side of a hydraulic cylinder 46 to the other side of the cylinder. During the time that the fluid is being throttled, a microswitch 47 is closed so as to energize an alarm system, generally designated by numeral 50. The alarm 50 may include audio and visual signals. Preferably the alarm system includes an alarm located adjacent to the door 20 which sounds when one tries to open the door to let the person opening the door know that his attempt to exit has been detected. In addition, an alarm may be located at a distant, central security station to alert security personnel that the door is being tampered with. As will be further explained hereinafter an electronic timing system is superimposed on the throttling delay and works in conjunction therewith so as to provide a redundant arrangement. Moreover, the delay function can be bypassed if an emergency situation occurs or if there is a power failure in the building so that the door 20** can open immediately under emergency conditions.

Figure 7:
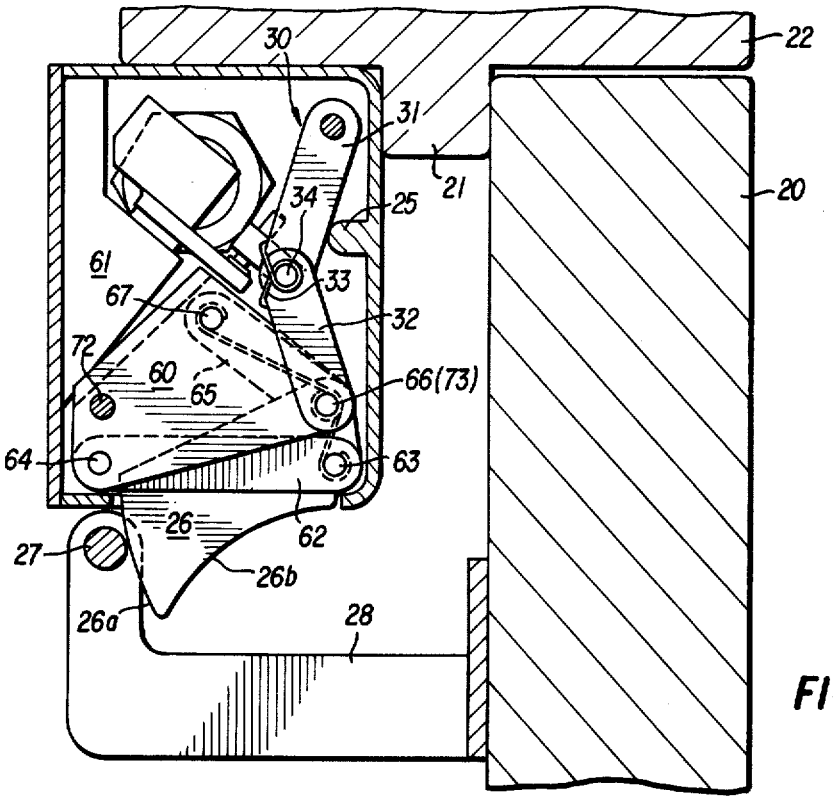
FIG. 7 is a side view of the bolt in accordance with the instant invention showing the bolt in projected position and engaged with the keeper so as to secure the door.
Figure 8:
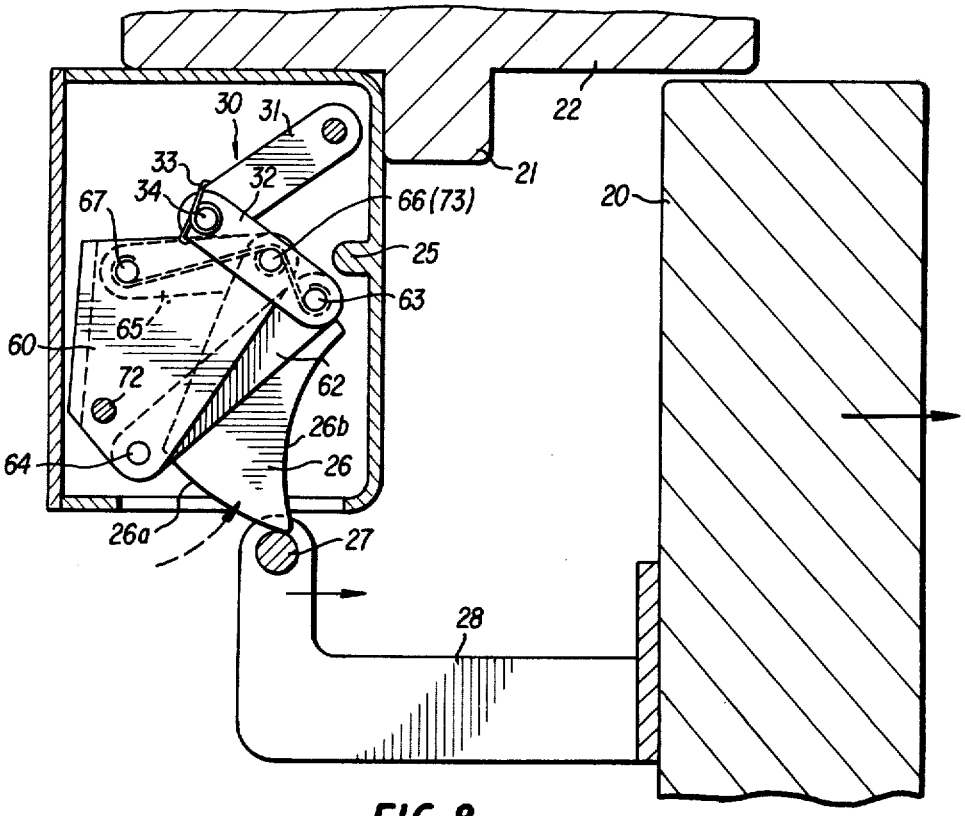
FIG. 8 is a view similar to FIG. 7 showing the bolt retracting by collapsing a toggle linkage so that the bolt will clear the strike.
Figure 9:
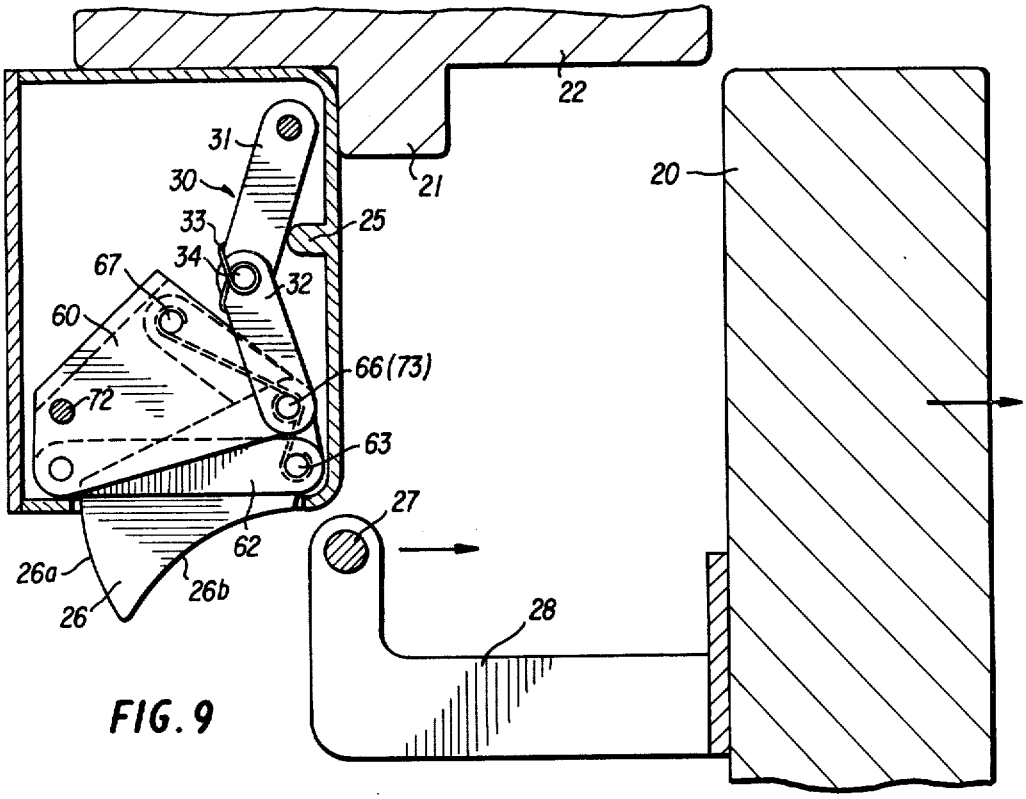
FIG. 9 shows the bolt projected after it has cleared the strike and the door is open.

The specific operation of the bolt 26 is seen in FIGS. 7 through 10. The bolt 26 is carried by a carrier link 60 which is U-shaped in cross section and is pivoted on supporting case 61 by pivot 72. The bolt 26 is pivoted to a first pair of links 62 by a pivot pin 63 and the first pair of links 62 is pivoted to the carrier link 60 by a pivot pin 64. The bolt 26 is also pivoted to a second pair of links 65 by pivot pin 66, the links 65 being pivoted to the carrier 60 by pin 67. In FIGS. 7–9, pin 66 underneath is concealed by pivot 73 of the toggle linkage 30. The link pairs 62 and 65 cooperate with the bolt 26 to form the movable links of two, parallel, four bar linkages which use the carrier link 60 as a frame of reference or ground so that the bolt 26 shifts and pivots with respect to the carrier link.

Figure 10:
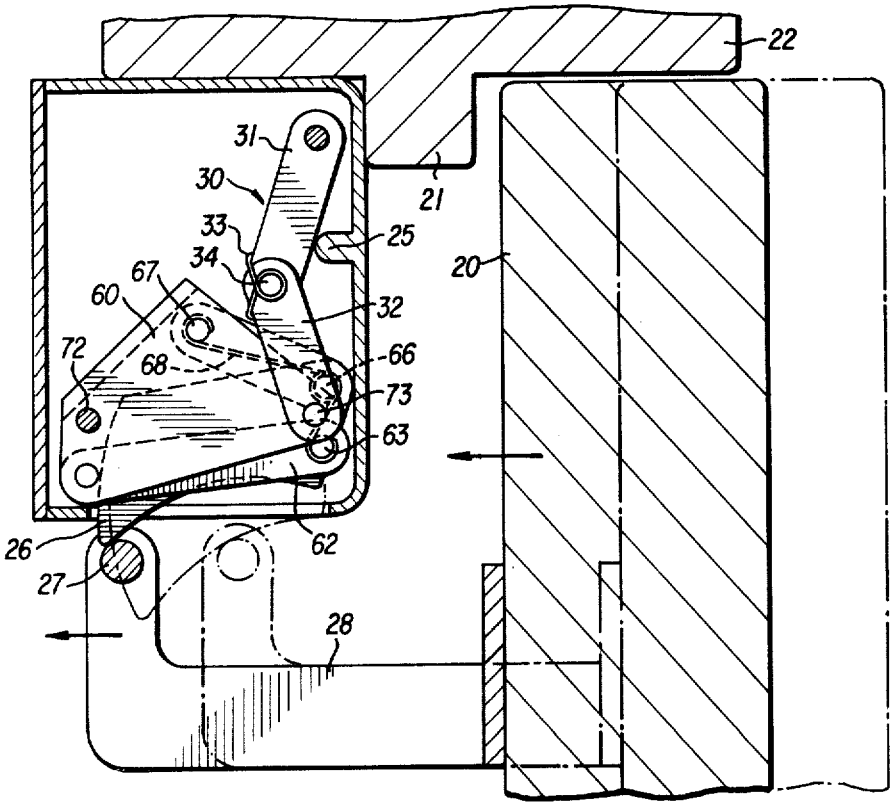
FIG. 10 shows the strike engaging the bolt upon closing the door.

As is seen in FIG. 10 the bolt 26 can move back into the carrier link 60 but is normally held projected therefrom by a coil spring 68 which is coaxial with pivot pin 66 and has one tail around the pivot pin 63 and the other tail around pivot pin 67.

The carrier link 60 is pivoted to the support structure 61 by the pivot pin 72 which is spaced from pivot pins 63, 64, 66 and 67 that support the bolt 26 within the carrier link 60. The toggle linkage 30 which includes the parallel links 32 and 31 which are pivoted to one another by pivot pin 34 is pivoted to the carrier link 60 by pivot 73 (see FIG. 10) and to the support casing 61 by pivot 64. The pivots 73 are disposed outside of pivot pin 66 in FIG. 10, and in FIGS. 7, 8, and 9 are aligned with pivot pin 66. Parallel links 31 are held separate and in rigid relation with respect to one another by a web **31*a* (see FIG. 6). Parallel links 31 fit inside the parallel links 32 so that the web 31*a* holds the links 32 spaced apart as well as holding the links 31** spaced apart.

The toggle linkage 30 is normally biased by a spring 33 to a first position shown in FIGS. 7, 9 and 10 so as to maintain the carrier link 60 rotated in the clockwise direction so that the bolt 26 remains projected. When in this first position, the toggle linkage 30 abuts the stop 29. Upon applying pressure to the door 20, the strike 27 applies force to the surface **26*a* of the bolt 26 which causes the carrier 60 to pivot counterclockwise about pivot 72 allowing the bolt 26 to clear strike 27. After the bolt 26 clears the strike 27, the toggle linkage 30 straightens under the influence of a spring 69 associated with the hydraulic circuit (See FIG. 11) and to a lesser extent under the influence of spring 33**.

In order to move the bolt 26 from the FIG. 9 position with respect to the strike 27 in which the door 20 is open back to the position of FIG. 8 in which the door is closed, it is again necessary to retract the bolt 26. However, the carrier 60 is loaded with the hydraulic delay circuit 45 and will not rotate counterclockwise about pin 72 rapidly enough so that one can easily close the door 20. Accordingly, the bolt 26 pivots with respect to the carrier 60 so that the bolt can retract while the carrier is held projected by the toggle 30. This is accomplished by pivoting the bolt 26 with respect to the carrier 60 by rotating the bolt about pivots 63 and 66 which causes the links 62 and 65 to rotate about pivots 64 and 67 so as to in effect shift the bolt back into the carrier as the bolt rotates about pivots 63 and 66. The progression of movement of the bolt 26 is then from the dotted line position of FIG. 10 to the solid line position during which progression the strike 27 engages surface 26*b* and presses the bolt back into the carrier 60. After the bolt 26 clears the strike 27, spring 68 straightens and projects the bolt behind the strike so that the bolt assumes the secured position of FIG. 7. Accordingly, retraction of the bolt 26 upon closing the door 20 is independent of the condition of toggle linkage 30. Therefore, the toggle linkage 30 can be continuously loaded by the hydrualic delay circuit 45.

Figure 11:
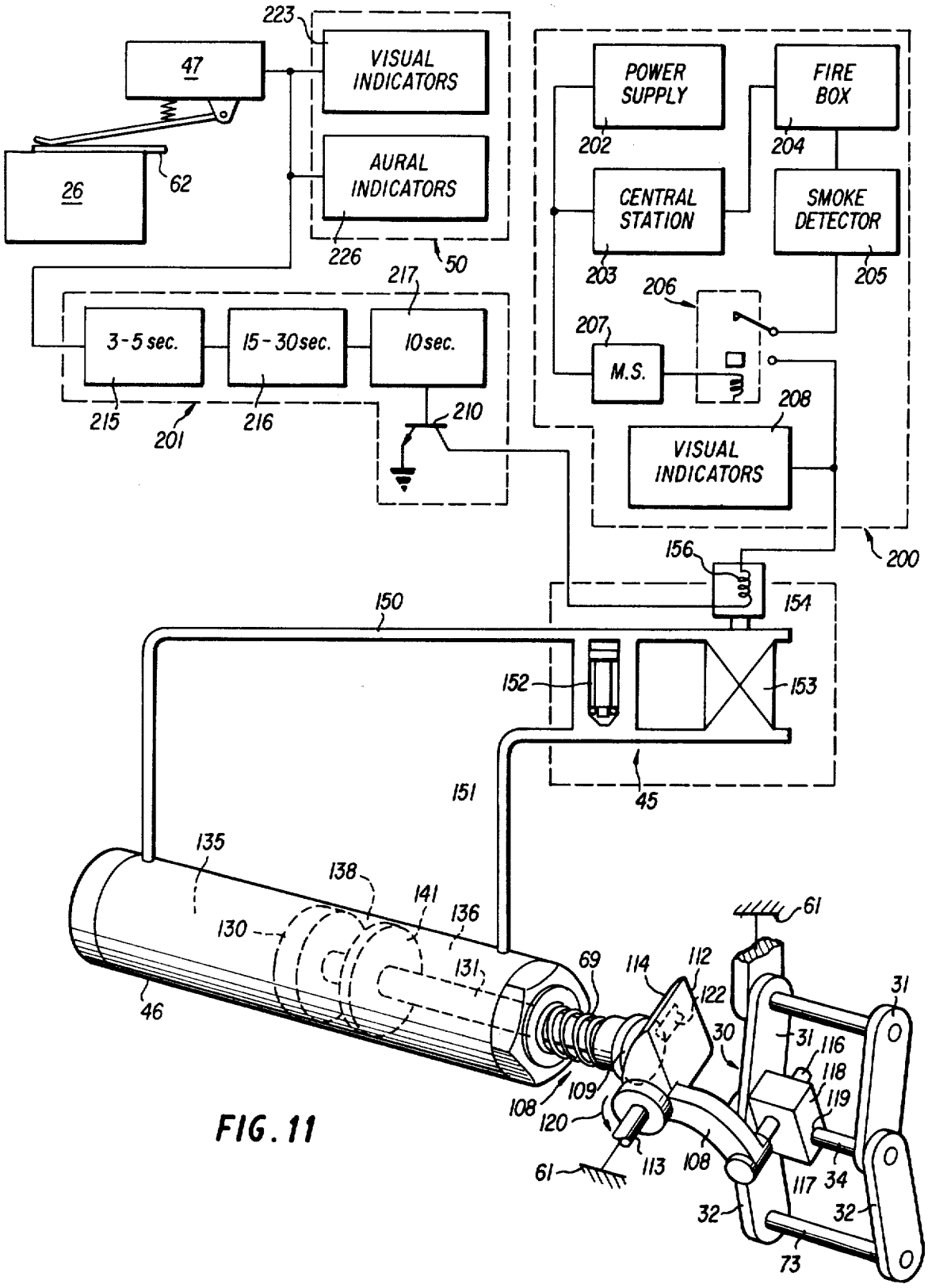
FIG. 11 is a schematic view showing a hydraulic and electrical system for effecting delay of bolt retraction.

Referring now to FIG. 11, the toggle linkage 30 is connected to the delay circuit 45 by a cam and linkage mechanism, designated generally by the numeral 108. The mechanism 108 engages in a follower 109 which drives a piston in hydraulic cylinder 46 against the bias of the spring 69 so as to displace hydraulic fluid which is throttled in the circuit 45.

The cam and link mechanism 108 consists of a bell crank 112 which is pivoted to the support structure 61 by a pivot 113. One arm of the bell crank 112 forms a cam 114 which abuts the piston rod follower 109, while the other arm of the bell crank is fixed to a connecting rod 116. The connecting rod 116 registers with a bore 117 in a sliding block 118. The sliding block 118 has a bore 119 which is perpendicular to the bore 117 and is slidably and rotatably mounted on pivot pin 34 which connects the link pair 31 and 32 together to form the toggle linkage 30. The pivot pin 113 which mounts bell crank 112 has an axis in a plane normal to the plane containing the axis of pivot pin 34. As the toggle linkage 30 moves from its first position (FIG. 7) towards its second position (FIG. 8), the block 117 slides down the pivot pin 34 so as to rotate the bell crank 112 in the direction of arrow 120 which lifts the piston rod follower 109 from a stop 122 thereby pressurizing the fluid in the cylinder 46 and circulating the fluid through delay circuitry 45. A piston 130 is secured to the piston rod follower 109 by a piston rod 131. Hydraulic fluid, such as automatic transmission fluid used in automobiles, is contained within the cylinder 46 and is displaced from a front chamber 135 of the hydraulic cylinder through the hydraulic circuitry 45 and accumulated in a rear chamber 136 on the other side of piston 130. The cylinder 46 is not completely filled with hydraulic fluid but includes a gas, such as air, contained in a space 138 adjacent the back surface 139 of the piston 130. As fluid is transferred from chamber 135 to chamber 136, the air in space 138 is compressed to provide additional volume in the chamber 136 which compensates for the space in the hydraulic cylinder consumed as the piston rod 131 moves into the chamber.

Preferably, there is a floating piston 141 which is coaxially and slidably mounted on the piston rod 131 above a stop 143 projecting from the piston rod. The floating piston 141 can move toward the piston 130 to compress air in space 138. By using the floating piston 141, the air is retained in space 138 so that the cylinder 46 can be oriented with the piston rod extending upwardly or horizontally instead of downwardly without the concern that air in the chamber 136 will float to the top (of the inverted cylinder 46) and escape through the seal between the piston rod 131 and the end of the cylinder. It is preferable to have hydraulic fluid adjacent to seal between the piston rod 131 and the housing of the hydraulic cylinder 46 because hydraulic fluid will not leak as readily as air.

The hydraulic circuit 45 is connected to the front chamber 135 of the hydraulic cylinder 46 by a hydraulic line 150. Another hydraulic line 151 connects the hydraulic delay circuit 45 to the accumulating side 136 of the cylinder 45. In order to control flow of the fluid, a check delay valve 152 is included in the circuit 45 in parallel with a normally open solenoid operated valve 153. The normally open valve 153 is held closed by a solenoid 154. When the normally open valve 153 is open, hydraulic fluid can be transferred rapidly from chamber 135 to chamber 136, however when the normally open valve 153 is closed then the hydraulic fluid must flow through the check delay valve 152 which throttles the fluid so that transfer of the fluid from the chamber 135 to the chamber 136 is delayed. When transfer of the fluid is delayed then retraction of the bolt 26 is delayed because the toggle linkage 30 is burdened with throttling the fluid as the linkage collapses.

One embodiment that the hydraulic delay circuit 45 may assume is the embodiment more specifically set forth in FIGS. 11-14 of U.S. patent application Ser. No. 22,100; filed Mar. 20, 1979 in the name of Roy E. Van der Linden and assigned to the assignee of the instant application. The Van der Linden application utilizes a check delay valve which has a spiral groove through which the hydraulic fluid is passed as it is throttled.

The solenoid 154 has a coil 156 which is connected at one end to an emergency situation control circuit 200 and at the other end to a timing circuit 201. The emergency situation circuit includes a power supply 202, a central station control panel 203 (which preferably includes switches for de-energizing solenoid 156 remotely), fire boxes 204, smoke detectors 205 and vibration sensors 205*a* (which bypass the delay when there is an earthquake or explosion. These elements are connected in series with a drop-out relay 206 which includes a manual reset switch 207. If either the fire boxes 204 or smoke detector 205 indicate an emergency condition, the drop-out relay 206 will be opened to cut off power from the power supply 202 to the solenoid 154. The solenoid 154 will then allow normally open valve 153 to open so that the fluid in line 150 need not be throttled by the check delay valve 152 in order to flow to line 151 and lower chamber 136 of cylinder 46. Accordingly, the door 20 will open immediately if an emergency condition is sensed or if, for any reason, power to the solenoid 154 is interrupted. The manual reset switch 207, which can be located at the central station 203, must be operated in order to reclose the drop-out relay 206. If an emergency condition persists, then the manual reset 207 preferably cannot reset drop-out relay 206. A visual indicator 208 in the form of a light is provided at the central station 203 and perhaps adjacent to the door 20 so as to indicate whether the door is operating in an emergency mode or in a delay mode.

The solenoid 154 is attached to ground through the emitter of a transistor 210 located in timing circuit 201. Normally, the transistor 210 is switched on so as to conduct power from power supply 202 to ground. However, when the transistor 210 is switched off, solenoid 154 is no longer energized and normally open valve 153 will open. The timing circuitry 201 includes a three to five second timer 215 which is preferably set at five seconds; a fifteen to thirty second timer 216, which is preferably factory set, and a ten second timer 217, which triggered by the timer 216 to turn off transistor 210 for a period of ten seconds. The timers operate in series and are connected to the microswitch 47 that is operated by an arm 221 which is pressed by spring 222 into engagement with the link 62 upon which the latch bolt 26 is pivoted. Upon pushing the door 20, toward the open position, the latch bolt 26 is cammed by the strike 27 toward the retracted position, carrying the link 62 back. After a slight movement of the bolt 26, the arm 121 moves off of link 62 and closes the microswitch 220 which starts the timer 215 and lights visual indicators 225 at the central station 203. The switch 220 also energizes an audio indicator or alarm 226 located adjacent the door 20 so as to indicate to the person trying to open the door and others in the vicinity of the door that the door has been tampered with. If desired, an audio indicator 226 may also be located at the central station 203.

Upon closing the switch 220, the first timer 215 is started and counts a time interval with a preferably duration of five seconds. If pressure on the door is discontinued before the five second interval expires, then the timer 216 is reset and will start all over again if the door 20 is again pushed. If pressure on the door is continued for five seconds, then the first timer 215 triggers the second timer 216 which runs for a period of fifteen to thirty seconds, the period being determined at the factory or perhaps during installation. The timer 216 cannot be stopped or reset after being started. Upon expiration of the time interval (preferably thirty seconds) which interval is programmed into the second timer 216, the second timer triggers the third timer 217 which interrupts power to the base of transistor 210 for an interval of ten seconds. When the transistor 210 is turned off, solenoid 154 will be de-energized and normally open valve 153 will open allowing the door 20 to open immediately. During this ten second interval, the door 20 may be opened and closed without the necessity of waiting for the time interval set by timer 116. Moreover, after the ten second interval has expired, the door 20 may be held open indefinitely, but once the door is allowed to close, the timing sequence must be reinitiated.

The electronic timing system operates in parallel with the hydraulic system so as to provide a fail-safe arrangement whereby if the hydraulic system does not operate, the electronic system will operate, and if the electronic system 201 fails for some reason the hydraulic system will still allow the door 20 to open. It is emphasized that the combination of the hydraulic system and electrical system provides isolation between the solenoid 154 and the mechanical forces transmitted through the bolt 26 into the latching and locking apparatus 25. Accordingly, the system will not jam due to mechanical forces preventing the emergency solenoid 154 from operating. Since the solenoid 154 merely allows the normally open valve 153 to open, a system with a very quick response is achieved whereby after the selected time interval, the door 20 will open immediately.

It is to be kept in mind that the system will operate without the throttling feature of the delay check valve 152. If, for example, it is desired to have a door securing system in which the securing member does not mechanically move until after the selected or desired time interval has expired, then the fluid in the fluid circuit can be prevented from moving as long as the normally open valve 153 is closed. Immediately upon opening the valve 153, the fluid can move from one side of the piston 130 to the other, thereby allowing the door 20 to open.

In the embodiment in which the delay check valve 152 is deleted, the latch bolt 26 does not move at all after the toggle 30 is broken. Consequently, the door 20 will remain tightly shut within the door frame 21 and the width of the space between the door and door frame will not change during the delay. Depending on the design of the door 20, this can be important because if the width of the space is too great, then a fire within the building can be fed with a stream of air coming in around the door 20 during the delay.

In essence, the locking and latching apparatus 25 is one embodiment of a securing means which prevents the door 20 from opening when in a first mode and allows the door to open when in a second mode. Transition between the first and second modes is effected by expiration of the delay interval provided by the timing circuit 201; by operation of at least one of the components 203, 204 or 205 of the emergency circuit 200, or by throttling enough fluid through the check delay valve 152 to permit the bolt 26 to retract. If an abrupt change is desired after the delay, then the check delay valve 152 can be eliminated as suggested in the previous paragraph.

Figure 12:
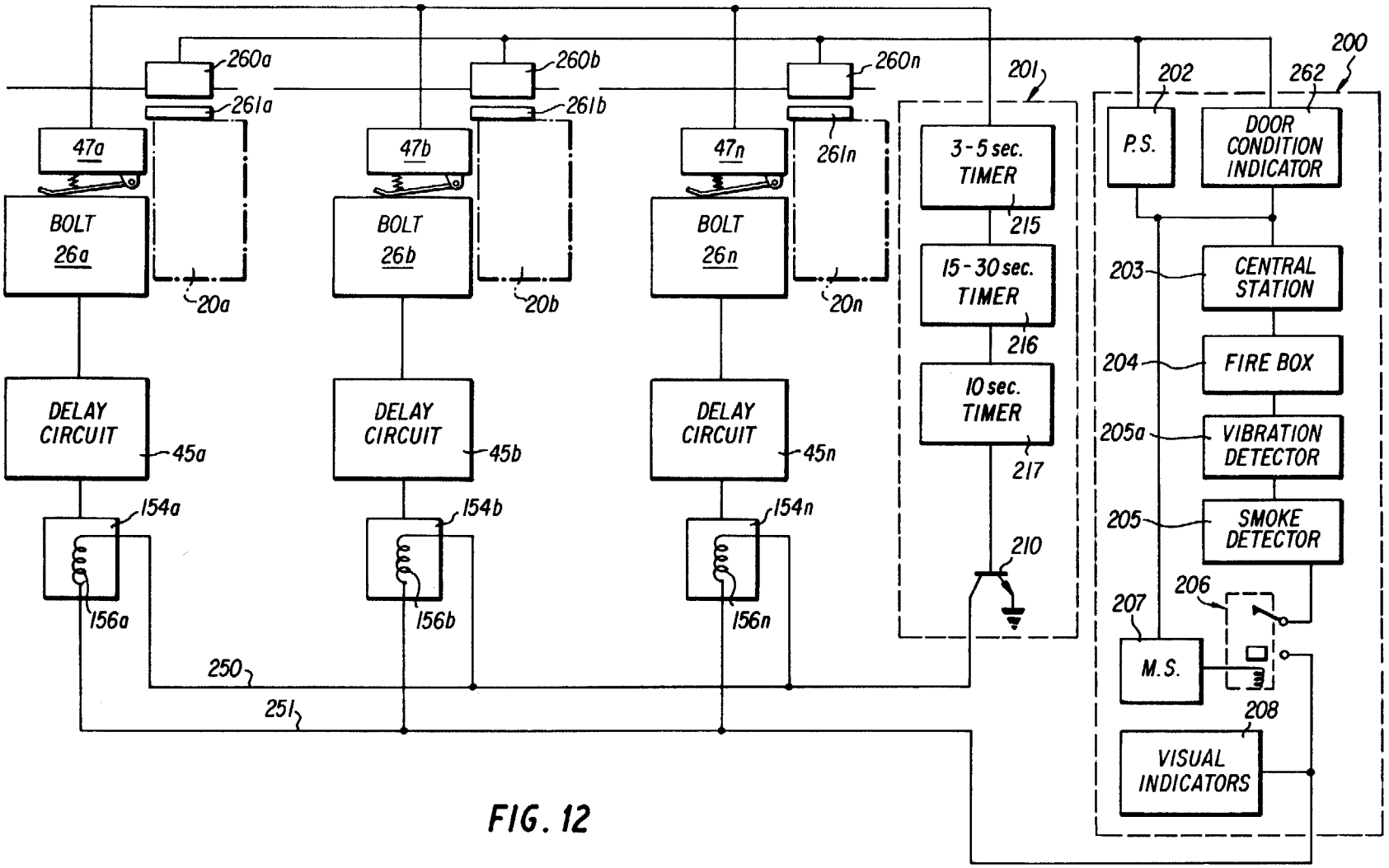
FIG. 12 is a schematic view of a delay system utilized with a polarity of doors.

Referring now to FIG. 12, there is shown an embodiment of the invention wherein a plurality of doors represented by numerals **20*a*–20*n* are connected to a single timing circuit 201 and a single emergency situation control circuit 200**.

In FIG. 13, coils **156*a*–156*n* of solenoids 154*a*–154*n* are in parallel across line 250 from the collector of transistor 210 and line 251 connected to the emergency situation control circuit 200. Accordingly, when the transistor 210 interrupts current from the power supply 202, which is preferably located in the circuitry 200, all of the doors 20*a*–20*n* are allowed to open although only one of the switches 47*a*–47*b* has been activated. Consequently, if the doors 20*a*–20*n*** are arranged in banks or perhaps five to twenty doors at one location in the building, then all of the doors will be released simultaneously upon attempting to open only one door.

It should be kept in mind that all of the doors **20*a*–20*n* remain latched even when the latches are in a quick opening mode and then, after the ten-second reset time, the doors are again secured. Each of the doors 20*a*–20*n* in the bank is individually openable after the time interval determined by its own hydraulic delay circuit 45. Consequently, the redundancy or override feature in the embodiment of FIG. 11 is also provided in the embodiment of FIG. 12**.

While the emergency situation control circuit 200 is shown operating one bank of doors in FIG. 12, it should be kept in mind that the same emergency circuitry can be used to operate numerous banks of doors, if necessary or desired. If, for some reason, individual banks of doors or groups of individual banks of doors need separate emergency situation control circuits 200, then separate circuits can be provided. To a large extent, this depends on the configuration and need of the building in which the system is employed.

In monitoring the condition of the doors **20*a*–20*n* or even of a single door, it is necessary to provide a separate indicator explaining whether each door is open or closed. This cannot be determined by the position of the bolts 26*a*–26*n* since, if a door is open and its bolt is projected, the switches 120*a*–120*n*** indicate to a remote station that the door is secure.

The conditions of the doors 20a–20n are monitored by magnetic reed switches 260a–260n mounted in the door jambs within which the doors are mounted. Permanent magnets 261a–261n are mounted within the edges of the doors 20a–20n to keep the magnetic reed switches closed. When one of the doors 20a–20n is opened, the associated magnet reed switch is opened which activates a remote indicator 262 at the security station. The indicator 262 can have both visual and audible signals and preferably identify the doors individually.

The foregoing is merely illustrative of the invention which is to be limited only by the following claims.

What is claimed is:

1. Apparatus for securing an emergency exit door wherein the door is hinged along one edge to a door frame;

means for latching the door;

panic bar means connected to the latching means for unlatching the latching means when force is applied to the bar;

delay means, separate from the latching means and panic bar means, said delay means including a closure operated bolt means which extends between the door and door frame for preventing the door from opening when projected and allowing the door to open when retracted, and means for retarding movement of the bolt means from the projected to the retracted position, and means for indicating that an attempt is being made to open the door while retraction of the bolt is being retarded.

2. The apparatus of claim 1 further including means for bypassing the retarding means, upon the occurrence of emergency condition wherein the bolt means can move immediately from the projected position to the retracted position.

3. The apparatus of claim 2 wherein the delay means is mounted on the door frame.

4. The apparatus of claim 3 wherein the bolt means is mounted on the door frame for projection from the frame into securing engagement with the door and reracts out of securing engagement with the door toward the frame.

5. The apparatus of claims 2, 3 or 4 wherein delay means includes:

means connected to the bolt for pressurizing a fluid as the bolt moves from the projected position to the retracted position; and means for throttling the fluid while the fluid is pressurized whereby movement of the bolt from the projected position to the retracted position is delayed.

6. The apparatus of claims 2, 3 or 4 wherein the delayed means includes:

means connected to the bolt for pressurizing a fluid as the bolt moves from the projected position to the retracted position;

means for throttling the fluid while the fluid is pressurized whereby movement of the bolt from the projected position to the retracted position is delayed, and wherein, the bypassing means includes a normally open valve connected to the throttling means and a solenoid connected to the normally open valve for holding the valve closed when the solenoid is energized and for allowing the valve to open when the solenoid is de-energized.

7. The apparatus of claims 2, 3 or 4 wherein the delaying means includes:

a fluid circuit including a fluid pressurizing means connected to the bolt for pressurizing the fluid upon retraction of the bolt means, and throttling means for retarding flow of the fluid in the circuit when the fluid is pressurized whereby retraction of the bolt is delayed;

wherein, the releasing means is a normally open, solenoid operated valve which is held closed when the solenoid is energized and which opens upon de-energizing the solenoid;

and wherein, the retarding means further includes an electronic timing circuit connected to the bolt by a switch which operates to start the timing circuit upon an occurrence of an attempt to open the door, which circuit is connected to the solenoid to de-energize the solenoid upon timing out, thereby allowing the door to open after a delay equal to the time predetermined by the timing circuit.

8. The apparatus of claim 2 or claim 4 wherein the bypassing means has a first condition and a second condition; wherein when in the first condition, the bypassing means allows the apparatus to bypass the retarding means and when in the second condition, the bypassing means does not permit the apparatus to bypass the retarding means;

means for normally biasing the bypassing means to the first condition;

means for applying electrical energy to the biasing means for holding the bypassing means in the second condition;

emergency condition sensing means; and means for connecting the emergency condition sensing means to the electrical power means for interrupting electrical power to the bypassing means upon the occurrence of an emergency condition, whereby the bolt can move immediately from the projected position to the retracted position.

9. Apparatus for securing an emergency exit door wherein the door is hinged along one edge to a door frame;

means for latching the door;

panic bar means connected to the latching means for unlatching the latching means when force is applied to the bar;

delay means, separate from the latching means and panic bar means, said delay means including a closure operated bolt means which extends between the door and door frame for preventing the door from opening when projected and allowing the door to open when retracted, and means for retarding movement of the bolt means from the projected to the retracted position;

means for indicating that an attempt is being made to open the door while retraction of the bolt is being retarded;

means for bypassing the retarding means wherein the bolt means can move immediately from the projected position to the retracted position upon operating the bypassing means, and at least one emergency condition indicator connected to the bypassing means for operating the bypassing means upon occurrence of the emergency situation to allow the door to open upon pressing against the door.

10. The securing apparatus of claim 9 wherein the delay means is mounted on the door frame.

11. Apparatus for securing an emergency exit door wherein the door is hinged along one edge to a door frame;

means for latching the door;

panic bar means connected to the latching means for unlatching the latching means when force is applied to the bar;

delay means mounted on the door frame and separated from the latching means and panic bar means, said delay means including a closure operated bolt means which extends between the door frame and door for preventing the door from opening when projected and allowing the door to open when retracted, and means for retarding movement of the bolt means from the projected to the retracted position;

means for indicating that an attempt is being made to open the door while retraction of the bolt is being retarded;

means for bypassing the retarding means wherein the bolt means can move immediately from the projected position to the retracted position upon operating the bypassing means, and at least one emergency condition indicator connected to the bypassing means for operating the bypassing means upon occurrence of an emergency situation to allow the door to open upon pressing against the door.

12. The apparatus of claims 10, 11 or 12 wherein the means for retarding movement of the bolt means includes an electronic timing circuit connected to the bolt means by a switch, which switch operates to start the timing circuit to run for a time interval upon an occurrence of an attempt to open the door, and release means connected to the electronic timing circuit and to the bolt means for operation by the electronic timing circuit to release the bolt means upon expiration of the time interval.

* * * * *